US007563755B2

(12) United States Patent
Moodycliffe et al.

(10) Patent No.: US 7,563,755 B2
(45) **Date of Patent: *Jul. 21, 2009**

(54) LAVATORY FRESHENING AND/OR CLEANING SYSTEM AND METHOD

(75) Inventors: Timothy I. Moodycliffe, Milwaukee, WI (US); Jerome J. Veltman, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 520 days.

This patent is subject to a terminal disclaimer.

(21) Appl. No.: 10/332,601

(22) PCT Filed: Jul. 11, 2001

(86) PCT No.: PCT/US01/21789

§ 371 (c)(1),
(2), (4) Date: Jun. 12, 2003

(87) PCT Pub. No.: WO02/04592

PCT Pub. Date: Jan. 17, 2002

(65) Prior Publication Data

US 2004/0019961 A1 Feb. 5, 2004

(30) Foreign Application Priority Data

Jul. 12, 2000 (GB) ..... 0017151.2

(51) Int. Cl.
*C11D 17/00* (2006.01)
*A62C 13/62* (2006.01)

(52) U.S. Cl. ..... 510/191; 510/192; 510/462; 510/506; 510/510; 239/302; 239/310; 239/316

(58) Field of Classification Search ..... 510/191, 510/192, 193, 389, 426, 473
See application file for complete search history.

(56) References Cited

U.S. PATENT DOCUMENTS

| | | | | |
|---|---|---|---|---|
| 4,657,701 | A | 4/1987 | Pietzsch | 252/522 |
| 4,891,150 | A * | 1/1990 | Gross et al. | 510/191 |
| 6,028,045 | A | 2/2000 | Bianchetti et al. | 510/309 |
| 6,066,293 | A | 5/2000 | Van Rees | 422/5 |
| 6,159,925 | A * | 12/2000 | Blandiaux | 510/437 |
| 6,255,267 | B1 * | 7/2001 | Nayar et al. | 510/191 |
| 6,291,418 | B1 * | 9/2001 | Mertens et al. | 510/417 |
| 6,346,508 | B1 * | 2/2002 | Leonard et al. | 510/417 |
| 6,425,406 | B1 * | 7/2002 | Klinkhammer et al. | 134/22.19 |
| 6,495,506 | B1 * | 12/2002 | Massaux et al. | 510/417 |

FOREIGN PATENT DOCUMENTS

| | | |
|---|---|---|
| CA | 2201406 | 10/1998 |
| DE | 19918183 A1 | 10/2000 |
| EP | 0425463 B1 | 1/1996 |
| EP | 0775741 A1 | 5/1997 |
| EP | 0920860 A2 | 6/1999 |
| WO | WO99/66139 | 12/1999 |

OTHER PUBLICATIONS

WPI Abstract Accession No. 1985-193166 [32] & JP 600119950 A (Johnson Corp) See abstract.

* cited by examiner

*Primary Examiner*—Necholus Ogden, Jr.

(57) ABSTRACT

A lavatory freshening and/or cleaning system comprises a dispenser for dispensing liquid composition from under the rim of a lavatory bowl. The dispenser is in the form of a reservoir arranged for suspension from the rim of a lavatory bowl, and the reservoir contains the liquid composition. The liquid composition comprises a combination of anionic and non-ionic surfactants having a total concentration equal to substantially 7.6 wt. %, a thickening agent having a concentration of 0.40 wt. % and a perfume having a concentration of 6.00 wt. %.

3 Claims, No Drawings

LAVATORY FRESHENING AND/OR CLEANING SYSTEM AND METHOD

This invention relates to a freshener and/or cleaner system for the lavatory and to a method of using such a system in a lavatory bowl. In particular, this invention relates to a system comprising a liquid freshening and/or cleaning composition and a liquid dispenser.

Several lavatory freshening and/or cleaning systems are known. These systems include "solid block" type systems, where a freshening and/or cleaning block is placed either under the rim of the lavatory or in the cistern. In the case of the under the rim system, water dissolves part of the block each time the lavatory is flushed, allowing the lavatory bowl to be cleaned and/or freshened. In the case of the cistern block system, part of the block dissolves in the cistern prior to flushing and the toilet is cleaned and freshened on flushing of the water held in the cistern into the lavatory bowl. However, solid toilet blocks have demonstrated several drawbacks, in particular their inability to deliver constant amounts of cleaning and freshening agents during the lifetime of the block.

Other freshening and cleaning systems are of the liquid-dispensing type. Such systems include a liquid dispenser and a liquid freshening and/or cleaning composition. A liquid dispenser suitable for such a system is disclosed in the applicant's published international patent application WO 99/66139. Such liquid dispensers generally comprise a reservoir and a liquid-conveying device in the form of a pad, or a plate having capillary channels formed therein, the liquid-conveying device and the reservoir being so connected as to allow the freshening and/or cleaning composition held in the reservoir to be transferred to the liquid-conveying device in a controlled manner. The liquid dispenser is positioned under the rim of a lavatory such that, during flushing, a sufficient amount of freshening and/or cleaning composition is transferred to the lavatory bowl to effect the cleaning of the bowl.

In order for liquid cleaning systems to be effective, the liquid dispenser must be provided with a suitable liquid cleaning and/or freshening composition. It is desirable that such a liquid composition possess certain properties in order to carry out its freshening and/or cleaning functions. In particular, it is desirable that, when the composition is dispensed by flushing, sufficient foaming occurs. Foaming is desirable in order to promote cleaning of the lavatory bowl and dispersal of any perfume which is contained in the composition. Foaming also confers certain aesthetic properties when the toilet is flushed.

A known liquid cleaning composition, stated to be suitable for liquid cleaning systems of the type hereinbefore described, is disclosed in European patent application EP-A-0 775 741, which describes a composition having a viscosity at room temperature of 10 to 2000 mPa s and comprising:

(a) 1 to 25 wt. % of perfume, (b) 10 to 50 wt. % of anionic or non-ionic surfactant, (c) 1 to 20 wt. % of non-evaporating, water soluble evaporation regulator, and (d) balance solvent.

It would be desirable to provide alternative formulations, and particularly formulations which can be manufactured at lower cost.

Prior-art liquid compositions, and indeed also prior-art solid rim-blocks, typically comprise a surfactant level of at least 10 wt. %. This is believed to be because such a quantity would be required to generate the desired level of foam.

It has surprisingly been found by the inventors of the present invention that high levels of foam can, however, be achieved with compositions containing low levels of surfactant and which are also suitable for use in liquid dispensers of the above type. Additionally, it has been discovered that high levels of foam can be achieved with compositions containing low levels of surfactant while also dissolving, or micro-emulsifying, any perfume present in the liquid composition for freshening.

Thus, in accordance with the present invention, there is provided a lavatory freshening and/or cleaning system comprising a dispenser for dispensing a liquid composition from under the rim of a lavatory bowl, said liquid composition comprising one or more surfactants having a total concentration not exceeding 8 wt. %.

Preferably, the total surfactant concentration is within the range 2.5 to 8.0 wt. %, the most preferred value being substantially 7.6 wt. %.

Suitable surfactants are anionic and/or non-ionic surfactants, although a combination of anionic and non-ionic surfactants is particularly desirable. The preferred anionic surfactant is an alkyl ether sulphate, such as that marketed under the trade name Steol CS 270 which contains active surfactant at a concentration of 70 wt. %, and the preferred non-ionic surfactant is an ethoxylated synthetic alcohol, such as that marketed under the trade name Lutensol AO8.

Optionally, perfume may be present to provide freshening of the lavatory bowl and its vicinity. A suitable perfume for the liquid composition is that marketed under the trade name Vertana 114.737.

The preferred total concentration of perfume is within the range 4 to 15 wt. %, the most preferred value being substantially 6 wt. %.

Although the combination of surfactant and perfume can act as a thickening agent, the composition preferably includes one or more additional thickening agents, having a preferred total concentration within the range 0.2 to 5 wt. %. The most preferred concentration of additional thickening agent is substantially 0.40 wt. %. A suitable thickening agent is a hydroxyethylcellulose such as that marketed under the trade name Natrasol 250 HHR.

In addition, humectants may also be present in the liquid composition. Humectants are desirable when a perfume is present, in order to regulate the evaporation of the perfume from the composition. Additionally, humectants are useful in preventing phase separation of, and precipitation from, the composition. Suitable humectants include glycols, glycoethers, alcohols, sugars and polyethers.

Optionally, the composition may comprise sequestrants, pH control agents, dyes and preservatives.

The invention extends to a method of use of such a lavatory freshening and/or cleaning system in a lavatory bowl.

A preferred embodiment of the present invention incorporates a liquid composition having the following components:

| Weight percent | Common name | Chemical name | Component type | Function |
|---|---|---|---|---|
| | Water | Water | | Solvent |
| 7.25 | Steol CS 270 (Containing 70% active surfactant) | Sodium Lauryl Ether Sulphate | Anionic surfactant | Perfume solublisation, form generation and viscosity building |
| 2.50 | Lutensol AO8 | | Non-ionic surfactant | Perfume solublisation, form generation and viscosity building |
| 7.00 | | Dipropylene Glycol | Short-chain hydrocarbon | Humectant |
| 2.00 | Dequest 2010 | | Phosphonate | Sequestrant |
| 1.60 | | Sodium Hydroxide (32 wt. % aqueous solution) | | Control of pH |
| 0.40 | Natrasol 250 HHR | | Cellulosic | Thickener |
| 0.005 | | | | Dye |
| 6.00 | | | | Perfume |
| 0.02 | Myacide BT | | | Preservative |

As can be seen from the above table, the composition comprises Steol CS 270. This includes an anionic surfactant at a concentration of 70 wt. %, so that the actual concentration of anionic surfactant in the composition is 5.1 wt. %, resulting in a total surfactant concentration in the composition of 7.6 wt. %.

The invention claimed is:

1. A lavatory freshening and/or cleaning system comprising a dispenser for dispensing a liquid composition from under the rim of a lavatory bowl from a reservoir suspended from the rim, said liquid composition comprising one or more foaming surfactants having a total concentration not exceeding 8 wt. %; wherein said liquid composition further comprises perfume present within the range 4 to 15 wt. % and a thickening agent and a phosphonate sequestrant; and wherein the surfactant and perfume in combination act to thicken the liquid composition apart from thickening effects of the thickening agent, and the concentration of said thickening agent as a percentage of the liquid composition, apart from the surfactant and perfume present in the liquid composition, is within the range 0.4 to 5 wt. %; and wherein said thickening agent is a hydroxyethylcellulose thickening agent;

wherein the dispenser has a plate having a capillary channel for controlling dispensing of the liquid composition or a pad for controlling dispensing of the liquid composition; and wherein the composition further comprises dipropylene glycol in an amount sufficient to prevent phase separation of the perfume from the composition.

2. A system as claimed in claim 1, wherein the total perfume concentration is at least 6 wt. %.

3. A system as claimed in claim 1, wherein said liquid composition further comprises a pH control agent, a dye or a preservative.

* * * * *